US005389853A

United States Patent [19]

Bigio et al.

[11] Patent Number: 5,389,853

[45] Date of Patent: Feb. 14, 1995

[54] INCANDESCENT LAMP FILAMENT WITH SURFACE CRYSTALLITES AND METHOD OF FORMATION

[75] Inventors: Laurence Bigio, Schenectady, N.Y.; Joseph M. Ranish, Cleveland Heights, Ohio; Clyde L. Briant, Charlton; Ronald H. Wilson, Schenectady, both of N.Y.; John F. Ackerman, Cheyenne, Wyo.

[73] Assignee: General Electric Company, Schenectady, N.Y.

[21] Appl. No.: 955,382

[22] Filed: Oct. 1, 1992

[51] Int. Cl.[6] ..... H01J 1/14; B05D 5/12

[52] U.S. Cl. ..... 313/341; 313/345; 313/355; 427/78; 427/111

[58] Field of Search ..... 313/341, 345, 355; 445/9, 10, 11, 16, 20, 48; 427/111, 534, 77, 78, 123, 124, 252; 140/71.5, 71.6

[56] References Cited

U.S. PATENT DOCUMENTS

| | | | |
|---|---|---|---|
| 2,243,849 | 6/1941 | Kratky | 427/111 X |
| 3,914,639 | 10/1975 | Barraeo et al. | 313/341 X |
| 4,020,383 | 4/1977 | Labadini et al. | 313/341 X |
| 4,143,295 | 3/1979 | Oguro | 313/341 X |
| 4,296,352 | 10/1981 | Berlec et al. | 427/111 X |
| 4,344,816 | 8/1982 | Craighead et al. | 156/643 |
| 4,519,785 | 5/1985 | Shaffer | 427/111 X |
| 4,707,632 | 11/1987 | Walsh | 313/112 |
| 4,942,331 | 9/1990 | Bergman et al. | 313/271 |
| 5,152,870 | 10/1992 | Levinson | 427/111 X |

OTHER PUBLICATIONS

H. G. Craighead, R. E. Howard, D. M. Tennant, "Selectively Emissive Refractory Metal Surfaces", 38 Applied Physics Letters 74 (1981).

"The Application of Tungsten Wire as the Light Source in Incandescent Electric Lamps"; D. J. Jones; Oct. 1973; pp. 503–512.

J. F. Waymouth, "Where Will the Next Generation of Lamps Come From?"; pp. 22–25 and FIG. 20, undated publication.

*Primary Examiner*—Donald J. Yusko
*Assistant Examiner*—Ashok Patel
*Attorney, Agent, or Firm*—Edmund P. Anderson; James Magee, Jr.

[57] ABSTRACT

The invention refers to a filament having improved emission of visible light. The emissivity of a tungsten filament is improved by depositing a layer of submicron-to-micron crystallites on the filament, the layer having substantially submicron spacing between crystallites. The crystallites being formed from tungsten or a tungsten alloy of up to 1 weight percent thorium, up to 10 weight percent of at least one of rhenium, tantalum, or niobium, and the balance substantially tungsten.

15 Claims, 5 Drawing Sheets

INCANDESCENT LAMP FILAMENT WITH SURFACE CRYSTALLITES AND METHOD OF FORMATION

The present invention relates generally to electric incandescent lamps, and more particularly to an improved filament of enhanced radiative efficiency in the visible wavelengths.

BACKGROUND OF THE INVENTION

Incandescent lamp filaments emit visible and non-visible radiation when an electric current of sufficient magnitude is passed through the filament. A substantial amount of energy radiated by an incandescent lamp filament, however, is in the form of non-visible radiation such as infrared radiation. As a consequence, the radiative efficiency of a typical tungsten filament, measured by the ratio of power emitted at visible wavelengths to the total radiated power over all wavelengths, is relatively low, on the order of 6 percent or less.

It has been observed that the radiative efficiency of such common filament materials as tungsten can be increased by texturing the filament surface with submicron sized features. A method of forming submicron features on the surface of a tungsten sample using a non-selective reactive ion etching technique is disclosed by H. G. Craighead, R. E. Howard, and D. M. Tennant in "Selectively Emissive Refractory Metal Surfaces," 38 *Applied Physics Letters* 74 (1981). Craighead et al. disclose that improved radiative efficiency results from an increase in the emissivity of visible light from the tungsten. As used herein, emissivity, is the ratio of the radiant flux, at a given wavelength, from the surface of a substance (such as tungsten) to the radiant flux emitted under the same conditions by a black body. The hypothetical black body is assumed to absorb all and reflect no radiation incident upon it.

Craighead et al. disclose that the emissivity of visible light from the textured tungsten surface was found to be twice that of a non-textured surface, and suggests that the increase is the result of a more effective coupling of the electromagnetic radiation from the textured tungsten surface to free space. The textured surface of the tungsten sample disclosed by Craighead et al. had depressions in the surface separated by columnar structures having a cross-section of approximately 0.15 micrometers (microns) and a height above the filament surface of approximately 0.3 microns.

Another method for enhancing incandescent lamp efficiency by modifying the surface of a tungsten lamp filament appears in a paper entitled "Where Will the Next Generation of Lamps Come From?", by John F. Waymouth, dated September 1989, pages 22–25 and FIG. 20, Fifth International Symposium on the Science and Technology of all Light Sources, York, England, Sep. 10–14, 1989. In this paper Waymouth hypothesizes that filament surface perforations measuring 0.35 microns across, 7 microns deep, and with walls 0.15 microns thick, would serve as waveguides which effectively couple radiation in the visible wavelengths between the tungsten and free space, but inhibit the emission of non-visible radiation from the filament. As compared to a conventional filament, the radiative efficiency of such a filament would be increased and less electrical energy would be required to produce the same lamp brightness. Waymouth discloses that the perforations on the filament could be produced by semiconductor lithographic techniques, but that the dimensions of the surface perforations are beyond current state-of-the-art capabilities.

In copending application Ser. No. 644,137, filed Jan. 22, 1991, another method of forming incandescent lamp filaments with patterned surface features of submicron-to-micron size cross section is disclosed. A filament is coated with one or more mask layers, and a selected pattern is cut into one mask layer with a laser beam. The features are formed on the filament surface by a stenciling method, where either a filament compatible material is deposited through the patterned mask layer, or the filament surface is etched through the pattern to form the submicron-to-micron sized surface features corresponding to the selected pattern.

It is an aspect of this invention to provide an incandescent lamp filament with improved emission of visible light, and having submicron-to-micron size crystallites on the surface thereof.

It is another aspect of this invention to form an incandescent lamp filament with improved emission of visible light by depositing submicron-to-micron size crystallites thereon.

BRIEF DESCRIPTION OF THE INVENTION

The filament of this invention provides increased emission of visible light without a concurrent increase of non-visible, such as infrared, radiation. As a result, an improved incandescent lamp can be formed from the filament having improved efficiency in the emission of visible light per watt consumed. The filament comprises a tungsten filament having an outer layer of submicron-to-micron crystallites with submicron spacing between crystallites, the crystallites being comprised of up to 10 weight percent of at least one of rhenium, tantalum, and niobium, up to 1 weight percent of thorium, and the balance substantially tungsten.

A method for improving the emissivity of a tungsten filament comprises, depositing a layer of submicron-to-micron crystallites on the filament. The layer having substantially submicron spacing between crystallites, and the crystallites being comprised of up to 1 weight percent of thorium, up to 10 weight percent of at least one of rhenium, tantalum, or niobium, and the balance substantially tungsten.

Preferably, the crystallites are deposited by chemical vapor deposition in an atmosphere of hydrogen and tungsten hexafluoride at a pressure of about 0.1 to 10 torr. The filament is heated to a temperature of about 1400° to 1600° C., and a flow of the hydrogen and tungsten hexafluoride is supplied to provide tungsten hexafluoride molecules to the filament surface at a rate of about $10^{18}$ per square centimeter per second or less.

DETAILED DESCRIPTION OF THE INVENTION

We have found that by forming submicron-to-micron sized crystallites on the surface of a tungsten filament, sub-micron sized grooves or valleys can be formed between the crystallites. The sub-micron sized grooves or valleys are on the surface of the tungsten filament and behave as black bodies for the visible wavelengths emitted from the filament surface or the crystallites, while appearing only as mild surface perturbations to the longer infrared wavelengths. As a result, the emissivity in the visible wavelengths is increased without significantly affecting the infrared emissivity of the filament.

However, a filament having an increase in emissivity at all wavelengths can improve the visible light output in applications such as halogen lamps having a filament chamber with an infrared reflecting and visible light transmitting coating, for example shown in U.S. Pat. No. 4,942,331, incorporated herein by reference. Reflective coatings on the lamp envelope reflect infrared wavelengths back on the filament to provide increased heating of the filament, and increased emission of visible light for the same amount of power consumed.

Figure 5:
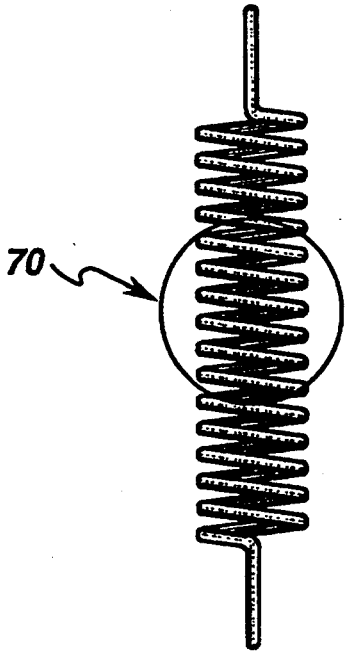
FIG. 5 is an illustration of a filament having a design known in the art as it would be incorporated in a lighting device of construction also known in the art.
Figure 5A:
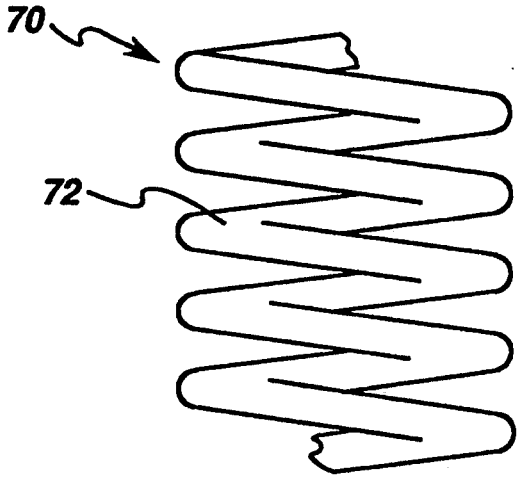
FIG. 5A is an enlargement of a portion of FIG. 5 further illustrating the surface of the filament of FIG. 5.
Figure 5B:
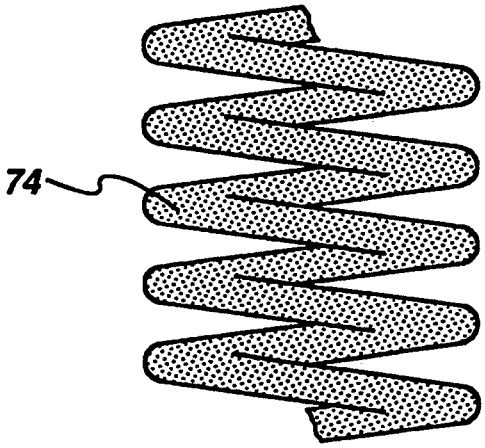
FIG. 5B is an illustration of the filament of FIG. 5A further illustrating an outer layer of crystallites on the filament.

Referring now to FIGS. 5, 5A and 5B, the tungsten filament 70 can be any of the conventional tungsten filaments, for example disclosed in, "The Application of Tungsten Wire as the Light Source in Incandescent Electric Lamps," D. J. Jones, The Metallurgist and Materials Technologist, October 1973, pages 503–512. For example, tungsten powder can be doped with at least one of potassium, thoria, or ceria, sintered to form a bar, and reduced to form the filament 70, for example a wire or ribbon. Preferably, the filament 70 has a surface 72 that promotes the formation of the microcrystallites. For example, the as reduced surface or a chemically etched surface on the filament 70 provides a surface 72 that promotes the formation of the submicron-to-micron crystallites. Suitable chemical etching materials include hydrogen peroxide, an aqueous solution of sodium hypochloride, or Murakami reagent, an aqueous solution of potassium ferricyanide and potassium hydroxide. It is believed submicron inhomogeneities on the as reduced or etched filament surface 72 provide sights for nucleation of the submicron-to-micron crystallites.

The submicron-to-micron crystallites 74 can be formed on the tungsten filament 70 by chemical vapor deposition of tungsten or a tungsten alloy comprised of up to 1 weight percent of thorium, up to 10 weight percent of rhenium, tantalum, or niobium, and the balance substantially tungsten. The layer of crystallites can be about 1 to 15 microns thick, preferably the crystallites have a cross section of about 0.5 to 3 microns in the plane parallel to the filament surface. Preferably, the crystallites are formed with a spacing between the facing surfaces of the crystallites of about 0.4 microns or less, more preferably, the average spacing between facing surfaces of the crystallites is about 0.1 to 0.4 microns.

At the operating temperature of some conventional filament applications, about 2200° to 2650° C., the grain boundaries between crystallites sinter to form stable surface grooves. The submicron grooves or valleys between crystallites serve as the desired black bodies. Over a prolonged period of time at the high operating temperatures of the filament, grain growth between crystallites can smooth the grooves or valleys between grains and reduce the effectiveness of the black bodies. The tungsten alloys comprised of up to 1 weight percent of thorium, up to 10 weight percent of rhenium, tantalum, or niobium, and the balance substantially tungsten are resistant to grain growth at the operating temperature, and help to stabilize the submicron grooves or valleys between crystallites.

In addition, a protective oxide coating of an oxide of thorium, hafnium, scandium, yttrium, cerium, or zirconium, can be deposited on the crystallites to minimize grain growth and smoothing of the valleys or grooves between the crystallites. The oxide coating is substantially transparent to the visible radiation emitted from the crystallites or filament surface. A suitable oxide coating can be about 0.005 to 25 microns, preferably, about 0.05 to 3 microns.

Figure 1A:
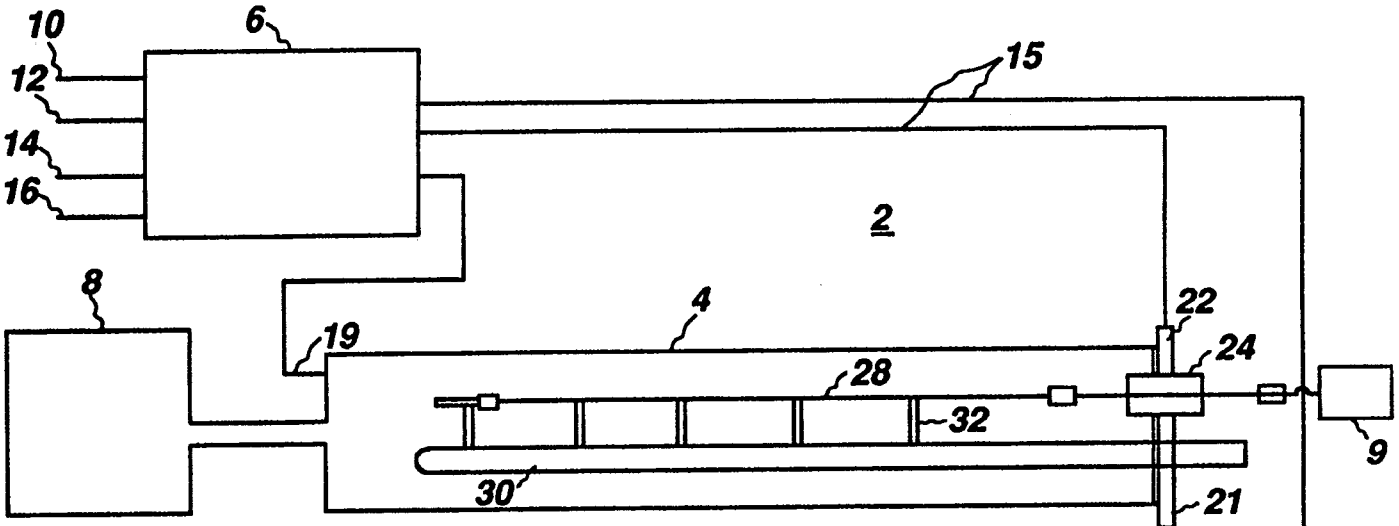
FIGS. 1A is a schematic side view of a chemical vapor deposition apparatus.
Figure 1B:
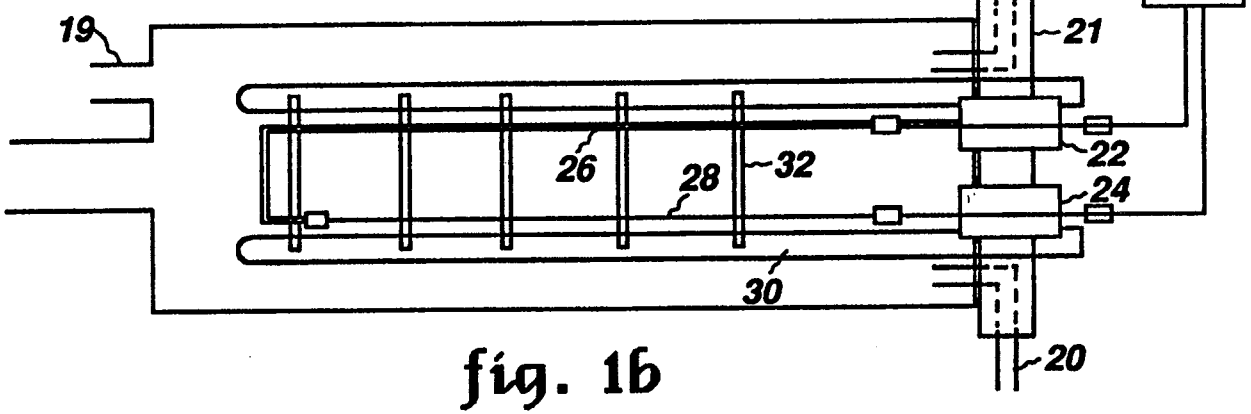
Figures 1B is a schematic top view of a reaction tube in the chemical vapor deposition apparatus.

A method for the chemical vapor deposition of the crystallites on the filament is shown by making reference to FIGS. 1A and 1B. FIGS. 1A and 1B are schematic side and top views, respectively, of a conventional low pressure chemical vapor deposition system 2. The low pressure chemical vapor deposition system 2 is comprised of a sealed reaction tube 4, a gas flow control system 6, vacuum pumping system 8, and power supply 9. Conventional gas supplies, not shown, supply nitrogen at connection 12, optionally a cleaning gas such as nitrogen trifluoride at connection 16, and reagent gases hydrogen at connection 10 and tungsten hexafluoride at connection 14 to the gas flow control system 6. The reaction tube 4 is formed from a material resistant to the tungsten hexafluoride, such as quartz.

The gas flow control system 6 is operatively connected by conventional tubing 15, formed from a corrosion resistant material such as stainless steel, to gas inlets 18 and 20 at an entrance end of the reaction tube 4, and to a purging gas inlet 19 extending through an exit end of the reaction tube 4. Inlets 18 and 20 extend through a seal plate 21, formed from a material resistant to reaction with tungsten hexafluoride such as stainless steel, at the entrance end of the reaction tube 4. Vacuum pumping system 8 applies a vacuum within the reactor tube 4, causing the reagent gases to flow from the inlets 18 and 20 to the exit end of the reaction tube 4.

Electrical connectors 22 and 24 extend through the seal plate 21 to a nickel rod 26 and a filament 28. The nickel rod 26 is formed in a J-shape to provide a spring load to tungsten filament 28 to minimize sagging of the filament during heating in the chemical vapor deposition process. The nickel rod 26 has a diameter substantially greater than the filament 28, for example about 18 times greater so that significant resistance self heating is limited to the filament 28. Quartz support rods 30, mounted in seal plate 21, having quartz plates 32 extending therebetween support the nickel rod 26 and the filament 28. Wires extend from electrical connections 22 and 24 to a conventional power supply 34 having variable voltage output control.

The reactor tube 4 is filled with nitrogen at inlet 19, and seal plate 21 is removed. A filament 28, such as a tungsten wire or ribbon, is mounted between electrical connector 24 and nickel rod 26. The filament 28 is loaded into the reactor tube 4, and sealed therein at seal plate 21. Vacuum system 8 is activated to maintain a pressure of about 0.1 to 10 torr inside the reactor tube 4. Gas supply system 6 is activated to supply hydrogen through inlet 18 at a flow rate of about 0.1 to 10 liter per minute. Power supply 9 is activated to provide current to heat the filament to about 1650° C. for about 2 minutes to reduce surface oxides on the filament. The power supply 9 is adjusted to provide a filament reaction temperature of about 1400° to 1600° C., preferably about 1450° to 1550° C.

In operation, the gas supply system 6 provides a flow rate of tungsten hexafluoride that provides tungsten hexafluoride molecules to the filament surface at a rate of about $10^{18}$ per square centimeter per second or less. For example, the gas supply 6 is activated to supply tungsten hexafluoride through inlet 20 at a flow rate of about 1 to 100 milliliter per minute, for about 1 to 60 minutes. The filament 28 is maintained at the reaction temperature until the tungsten hexafluoride is purged from the reaction tube 4. The flow of hydrogen is stopped, and a nitrogen flow purges the reactor tube for about 3½ minutes. The vacuum pumping system 8 is stopped, and the reactor tube is filled with nitrogen and opened at seal plate 21 to remove filament 28.

Those skilled in the art can determine the flow rates or tungsten hexafluoride and hydrogen required to provide the tungsten hexafluoride molecules to the filament surface at a rate of about $10^{18}$ per square centimeter per second or less depending upon the size of the filament and reaction tube. In addition, modifications can be made to the reaction tube to provide additional gas inlets for more even distribution of the reagent gases over the filament.

Those skilled in the art can substitute other known reagent gases in the chemical vapor deposition process described above, for example, tungsten hexachloride or tungsten carbonyl can be substituted for the tungsten hexafluoride. Known reagents for codepositing with tungsten to form the tungsten alloy crystallites, include rhenium hexafluoride, thorium tetrabromide, tantalum pentafluoride, and niobium pentafluoride. Those skilled in the art can provide the codeposited reagent in an amount to form the desired alloy. For example, crystallites comprised of 10 weight percent rhenium, and the balance tungsten can be formed by substituting 10 volume percent of the tungsten hexafluoride component of the atmosphere during chemical vapor deposition with a flow of rhenium hexafluoride.

Figure 2:
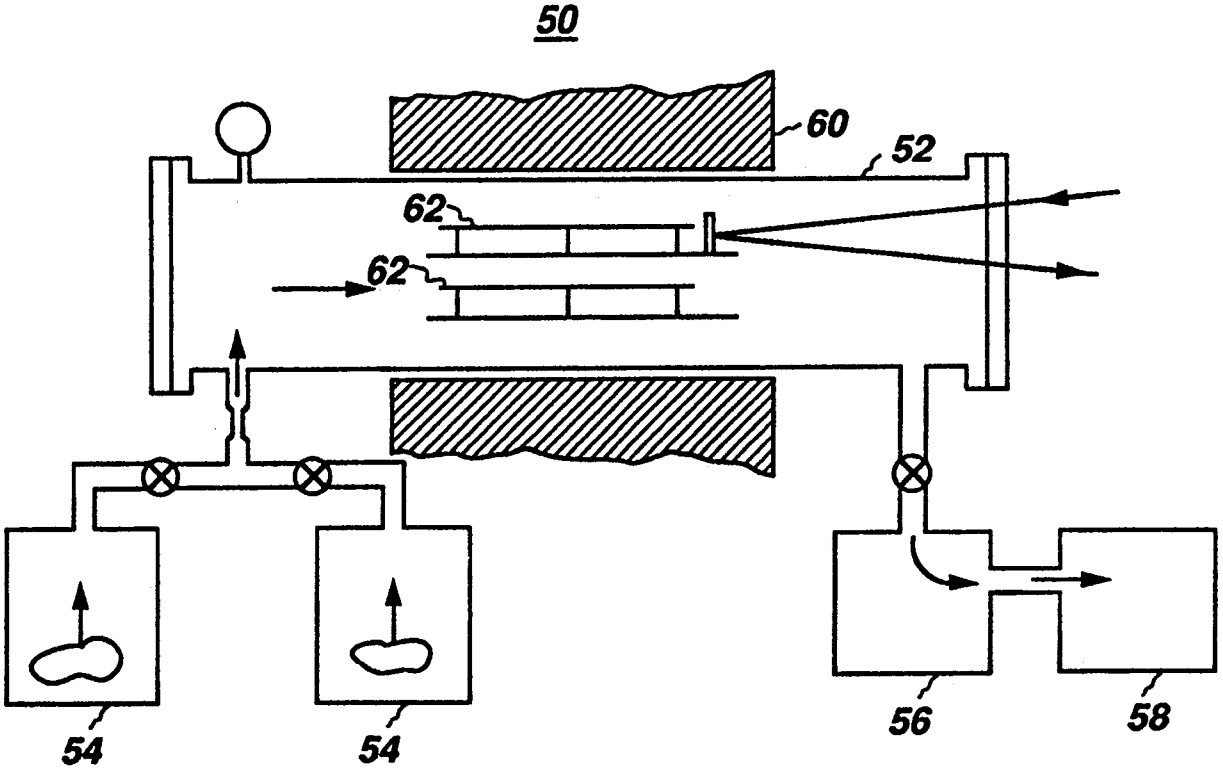
FIG. 2 is a schematic side view of a chemical vapor deposition apparatus coupled with evaporation cells.

The protective oxide coating of thorium, hafnium, scandium, yttrium, cerium, or zirconium can also be deposited by chemical vapor deposition. A suitable chemical vapor deposition process is shown by making reference to FIG. 2. FIG. 2 is a schematic diagram of a conventional low pressure chemical vapor deposition apparatus coupled with evaporator cells. The chemical vapor deposition system 50 is comprised of a reactor tube 52, evaporator cells 54, condensors 56, and vacuum pumping system 58. The evaporator cells 54 are comprised of heaters suitable for heating a precursor material to a temperature that produces a reagent vapor pressure greater than about 100 millitorr. A precursor material suitable for forming a reagent vapor that can be pyrolized to deposit each of the oxide coatings is shown below in Table I.

TABLE I

| Precursor | Oxide Coating |
|---|---|
| Scandium Tris(2,4-Pentanedionate) | $Sc_2O_3$ |
| Thorium Tetra (2,4-Pentanedionate) | $ThO_2$ |
| Hafnium Tetra (t-Butoxide) | $HfO_2$ |
| Yttrium Tris (2,2,6,6,Tetramethyl-3,5-Heptandionate) | $Y_2O_3$ |
| Zirconium Tetra (2,4-Pentanedionate) | $ZrO_2$ |
| Cerium Tetra (2,2,6,6, Tetramethyl-3,5 Heptandionate) | $Ce_2O_3$ |

The reactor tube 52 is surrounded by a heater 60 suitable for heating to a temperature where the reagent vapor is pyrolyzed, leaving the oxide coating on the filament. The vacuum pumping system is activated to provide a reduced pressure in the reactor tube 52, to provide a flow of reagent vapor from the evaporator cells 54 through the heated reactor tube. The precursor material suitable for forming the desired oxide coating is placed in the evaporator cell 54, and a filament 62 is placed in the evacuated reactor tube. The heater 60 is activated to heat the filament 62 to about 540° C., and the evaporator cell is heated to about 150°–250° C. to vaporize the precursor material. The vacuum pumping system 58 provides a suitable vacuum in the reactor tube to provide a flow of the vaporized reagent through the reaction tube 52.

The filament 62 is heated and exposed to the reagent vapor for a period of time sufficient to form the desired oxide film from about 0.005 to 25 microns, preferably about 0.05 to 3 microns. For example, a film of about 0.5 microns can be formed in about 60 minutes. A carrier gas such as nitrogen, hydrogen, water vapor, or air may be flowed through the reactor tube during the vapor deposition to improve the uniformity of coating deposition. When the desired coating thickness has been achieved, the heaters are removed, and the evaporator cell and reactor tube are allowed to cool. The vacuum is released and the coated filament is removed from the reaction tube.

EXAMPLE 1

A layer of tungsten crystallites was formed on a first tungsten filament, a ribbon about 0.005 by 0.25 by 20 centimeters, in the chemical vapor deposition apparatus shown in FIGS. 1A and 1B. An initial current of 15 amps was applied to the filament to heat it to about 1550° C., in a hydrogen flow of about 2 liter per minute at a pressure of 1 torr for about 3 minutes. The voltage from the power supply was kept constant to the filament, while a flow of tungsten hexafluoride of about 5 milliliter per minute was provided through the reaction tube for about 10 minutes.

EXAMPLE 2

A layer of tungsten crystallites was formed on a second tungsten filament, a ribbon about 0.005 by 0.125 by 20 centimeters, by the method in Example 1 except as noted herein. A current of 7.5 amps was applied to a filament.

Figure 3:
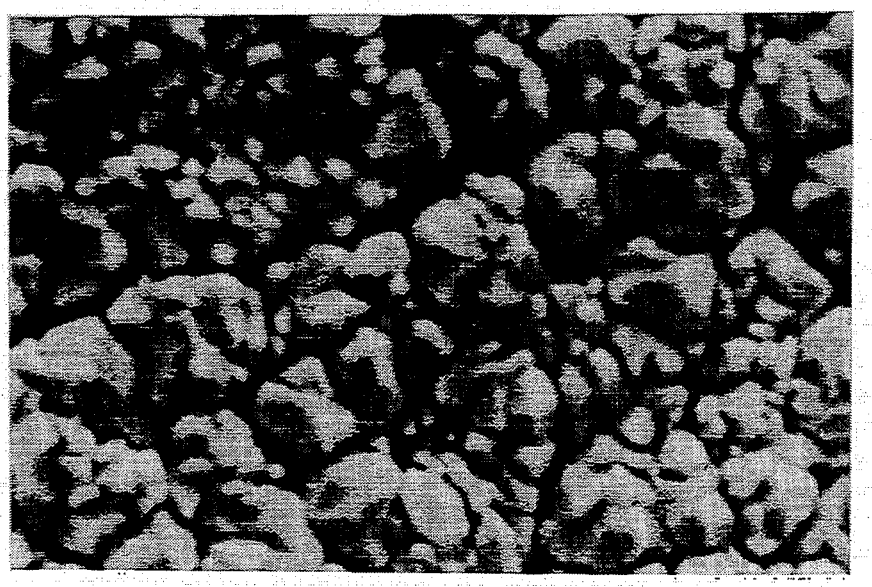
FIG. 3 is a scanning electron micrograph of submicron-to-micron tungsten crystallites deposited on a tungsten filament.
Figure 4:
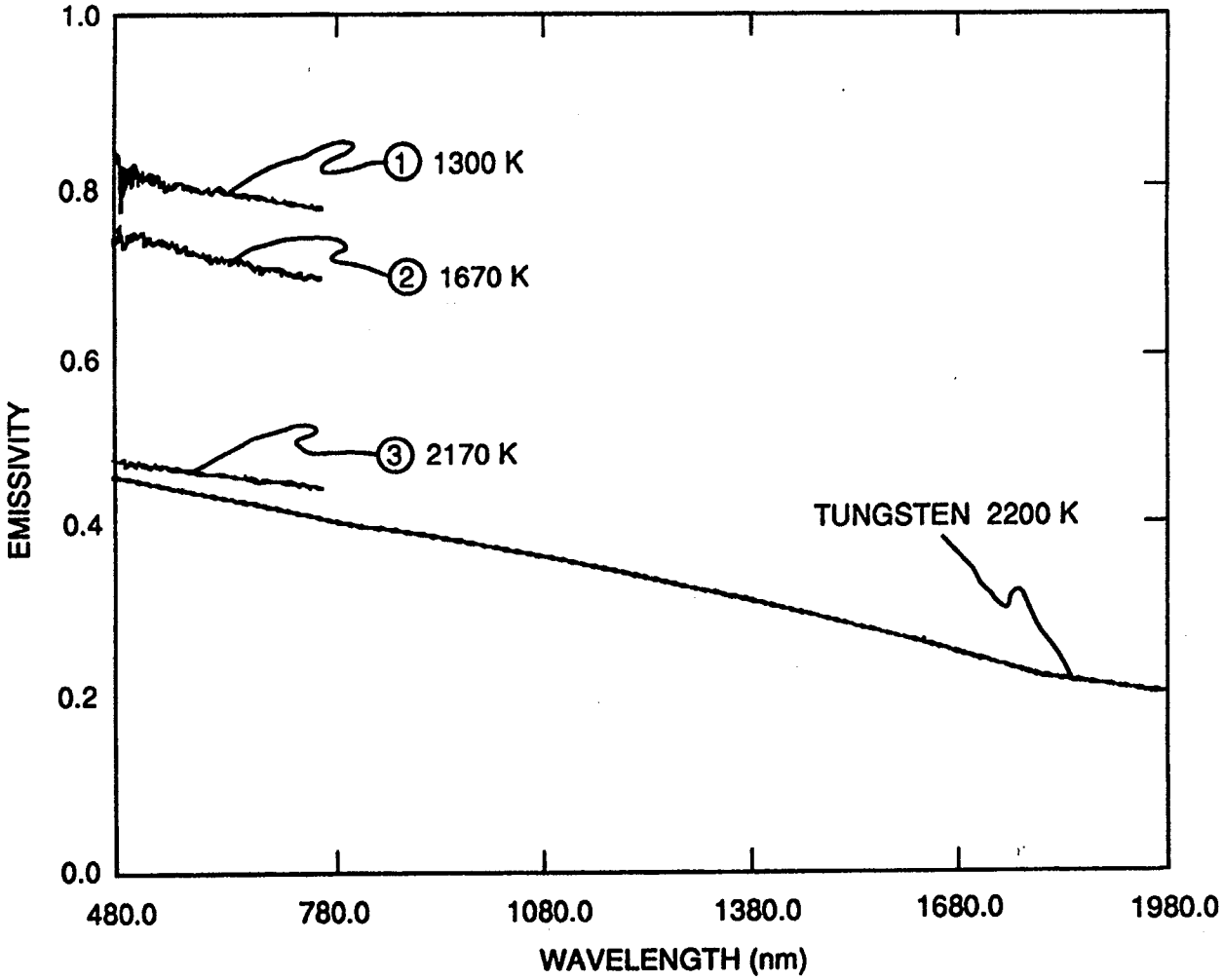
FIG. 4 is a graph showing the emissivity of a tungsten filament coated with crystallites as compared to an uncoated filament.

FIG. 3 is a scanning electron micrograph of the surface of the first tungsten filament showing the submicron-to-micron sized crystallites deposited thereon. The emissivity of the second filament surface coated with the crystallites was measured with a conventional spectrophotometer. Briefly described, the emissivity was measured while the filament was heated for about 30 to 40 minutes to each of about 1300K, 1670K, and 2170K. The average emissivity at each temperature is shown in FIG. 4. For comparison, the known emissivity of a tungsten filament at 2200K is also shown on FIG. 4.

FIG. 4 shows a substantial increase in emissivity in the visible light waves of about 480 to 780 nanometers, for the filament having the layer of tungsten crystallites deposited thereon as compared to an uncoated tungsten filament. As the temperature of the filament was increased, the improvement in emissivity decreased. It is believed the decrease in the improvement in emissivity was due to surface diffusion, and smoothing of the crystallites and the grooves therebetween. Crystallites formed from the tungsten alloys, or coated with the protective oxide coatings described above should provide improved crystallite stability, and reduce the decrease in emissivity improvement as filament temperature increases.

What is claimed is:

1. A filament having improved emission of visible light comprising, a tungsten filament having an outer surface and a layer of submicron-to-micron crystallites metallically bonded to the outer surface with submicron spacing between crystallites, the crystallites being comprised substantially of tungsten with up to 1 weight percent thorium and up to 10 weight percent of at least one of rhenium, tantalum, and niobium.

2. A filament according to claim 1 wherein the crystallites have an average cross section of about 0.5 to 3 microns.

3. A filament according to claim 2 wherein the average spacing between facing crystallite surfaces is about 0.1 to 0.4 microns.

4. A filament according to claim 1 wherein the crystallites are coated with a layer of at least one oxide of thorium, hafnium, scandium, yttrium, cerium, or zirconium.

5. A filament according to claim 3 wherein the crystallites are coated with a layer of at least one oxide of thorium, hafnium, scandium, yttrium, cerium, or zirconium.

6. A method for improving the emissivity of a tungsten filament comprising, depositing a layer of submicron-to-micron crystallites on an outer surface of the filament, the layer having substantially submicron spacing between crystallites, and the crystallites being comprised substantially of tungsten with up to 1 weight percent of thorium and up to 10 weight percent of at least one of rhenium, tantalum, and niobium.

7. A method according to claim 6 wherein the step of depositing comprises chemical vapor deposition in an atmosphere of hydrogen and tungsten hexafluoride at a pressure of about 0.1 to 10 torr, heating-the filament to a temperature of about 1400° to 1600° C., and supplying a flow of the hydrogen and tungsten hexafluoride to provide tungsten hexafluoride molecules to the filament surface at a rate of about $10^{18}$ per square centimeter per second or less.

8. A method according to claim 6 further comprising, preparing the outer surface of the filament to promote the formation of the crystallites, said preparing performed prior to depositing the layer of crystallites on the filament.

9. A method according to claim 8, wherein said preparing the outer surface comprises etching of the outer surface of the filament.

10. A method according to claim 8, wherein said preparing the outer surface comprises reducing the outer surface of the filament.

11. A method according to claim 7 wherein the deposition is for about 1 to 60 minutes.

12. A method according to claim 7 wherein the crystallites have an average cross section of about 0.5 to 3 microns.

13. A method according to claim 12 wherein the average spacing between facing crystallite surfaces is about 0.1 to 0.4 microns.

14. A method according to claim 6 comprising the additional step of depositing a layer of an oxide of thorium, hafnium, scandium, yttrium, cerium, or zirconium on the crystallites.

15. A method according to claim 13 comprising the additional step of depositing a layer of an oxide of thorium, hafnium, scandium, yttrium, cerium, or zirconium on the crystallites.

* * * * *